US009421797B2

(12) United States Patent
Speith et al.

(10) Patent No.: US 9,421,797 B2
(45) Date of Patent: Aug. 23, 2016

(54) PRINTER HAVING SEPARATING DEVICE

(71) Applicant: Weidmueller Interface Gmbh & Co. KG, Detmold (DE)

(72) Inventors: Markus Speith, Paderborn (DE); Thorsten Bornefeld, Schlangen (DE); Andreas Wieneke, Lemgo (DE); Andreas Toepper, Horn-Bad Meinberg (DE); Rene Manke, Bielefeld (DE); Michael Gockel, Bad Driburg (DE)

(73) Assignee: Weidmueller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 14/403,083

(22) PCT Filed: May 13, 2013

(86) PCT No.: PCT/EP2013/059794

§ 371 (c)(1),
(2) Date: Nov. 21, 2014

(87) PCT Pub. No.: WO2013/178455

PCT Pub. Date: Dec. 5, 2013

(65) Prior Publication Data

US 2015/0217582 A1 Aug. 6, 2015

(30) Foreign Application Priority Data

May 31, 2012 (DE) ..... 20 2012 101 998 U

(51) Int. Cl.
*B65H 3/24* (2006.01)
*B41J 13/00* (2006.01)
(Continued)

(52) U.S. Cl.
CPC ..... *B41J 13/0045* (2013.01); *B65H 1/06* (2013.01); *B65H 3/042* (2013.01); *B65H 3/24* (2013.01);
(Continued)

(58) Field of Classification Search
CPC ..... B41J 13/0045; B65H 1/06; B65H 9/06; B65H 3/042; B65H 5/021; B65H 3/0615; B65H 3/063; B65H 3/0653; B65H 3/085; B65H 3/24
USPC ..... 209/534; 194/206, 207; 414/796.1; 271/131, 132, 133, 138, 139, 140, 141, 271/90, 91, 92, 93, 95
See application file for complete search history.

(56) References Cited

U.S. PATENT DOCUMENTS 3,202,420 A * 8/1965 Dovey ..... B21D 43/20 271/99
4,133,020 A 1/1979 MacLean
(Continued)

FOREIGN PATENT DOCUMENTS

DE 689 15 452 T2 5/1990
DE 40 35 562 A1 5/1992
(Continued)

*Primary Examiner* — Thomas Morrison
(74) *Attorney, Agent, or Firm* — Lawrence E. Laubscher, Sr.; Lawrence E. Laubscher, Jr.; Robert D. Spendlove

(57) ABSTRACT

Printing apparatus is provided for printing information on a vertical stack of horizontal vertically-spaced planar objects arranged in a housing, including a separating arrangement for removing the lowermost object from the stack, and a printing device for printing information on the removed object. The stack is supported by a plurality of support arrangements each including a support member mounted for reciprocatory horizontal displacement by an electromagnetic drive device between positions that are adjacent and remote from the stack, respectively. Each support member is guided during this displacement by a guide arrangement including at least one guide lever having a first end pivotally connected with the housing, and a second end connected with a guide follower roller that is in engagement with a guide cam surface carried by the support member. The generation of noise is avoided as a consequence of the accurate guidance of the components.

15 Claims, 6 Drawing Sheets

(51) Int. Cl.

| | |
|---|---|
| ***B65H 3/34*** | (2006.01) |
| ***B65H 1/06*** | (2006.01) |
| ***B65H 3/04*** | (2006.01) |
| ***B65H 5/02*** | (2006.01) |
| ***B65H 9/06*** | (2006.01) |

(52) U.S. Cl.
CPC ..... *B65H 3/34* (2013.01); *B65H 5/021* (2013.01); *B65H 9/06* (2013.01); *B65H 2403/5331* (2013.01); *B65H 2701/1914* (2013.01)

(56) References Cited

U.S. PATENT DOCUMENTS

| | | | | |
|---|---|---|---|---|
| 5,833,228 | A | 11/1998 | Nagata et al. | |
| 7,665,920 | B2 * | 2/2010 | Hoffman | B41J 13/12 271/147 |

FOREIGN PATENT DOCUMENTS

| | | | |
|---|---|---|---|
| EP | 1842680 | A1 | 10/2007 |
| GB | 386837 | A | 1/1933 |

* cited by examiner

PRINTER HAVING SEPARATING DEVICE

REFERENCE TO RELATED APPLICATIONS

This application is a national stage application under 35 U.S.C. §371 of PCT International Application No. PCT/EP2013/059794 filed May 13, 2013, based on the German Application No. 20 2012 101 998.1 filed May 31, 2012.

BACKGROUND OF THE INVENTION

1. Field of the Invention

Printing apparatus is provided for printing information on a vertical stack of horizontal vertically-spaced planar objects arranged in a housing, including a separating arrangement for removing the lowermost object from the stack, and a printing device for printing information on the removed object. The stack is supported by a plurality of support arrangements each including a support member mounted for reciprocatory horizontal displacement by an electromagnetic drive device between positions that are adjacent and remote from the stack, respectively. Each support member is guided during this displacement by a guide arrangement including at least one guide lever having a first end pivotally connected with the housing, and a second end connected with a guide follower roller that is in engagement with a guide cam surface carried by the support member.

2. Description of Related Art

In the patented prior art, it is known from German patent No. DE 197 58 483 C2 to provide a printer for printing media such as plastic cards or mats with labels. These printing media have a relatively great material thickness, so that the requirements imposed on the printer are different from those for customary paper printers. In particular it is necessary to ensure that a high print quality is attained for printing plastic cards or mats as well. A plate-like, rigid printing medium of this type is described in German Application No. DE 20 2006 005 458 U1.

The printing media such as plastic cards or mats are located in the printer in a stack, one atop the other, and must be separated before printing. This can take place in a separate separating device arranged ahead of the printer, or the printer may be equipped with a separating device.

However, in the previously known separating devices, especially metal components are moved against a stop to establish an end position. In this process, the components hit the stop without prior deceleration, frequently leading to development of noise. In addition, the components become eroded by the high mechanical stress.

The use of damping systems in printers of the class mentioned is very complicated. For example, the maintenance effort is very high in the case of hydraulically operating damping systems. The use of elastic materials for damping causes the drawback that the elasticity of the materials means that exact positioning of the components can no longer be guaranteed. In addition, such components can harden over time and thus lose their damping effect.

SUMMARY OF THE INVENTION

Accordingly, a primary object of the present invention is to provide a printing apparatus on a vertical stack of horizontal vertically-spaced planar objects arranged in a housing, including a separating arrangement for removing the lowermost object from the stack, and a printing device for printing information on the removed object.

According to a more specific object, the stack is supported in the housing by a plurality of support arrangements each including a support member mounted for reciprocatory horizontal displacement by an electromagnetic drive device between positions that are adjacent and remote from the stack, respectively. Each support member is guided during this displacement by a guide arrangement including at least one guide lever having a first end pivotally connected with the housing, and a second end connected with a guide follower roller that is in engagement with a guide cam surface carried by the support member. A row of horizontal support pins extends from the support plate into the vertical zone defined by the stack. In one embodiment of the invention, two guide levers are provided that are connected by a connecting rod, thereby to provide a parallelogram-type guidance system. In another embodiment, a single guide lever is utilized in conjunction with a stationary guide track and roller arrangement. This separating and printing operation is achieved in a relatively noise-free manner, since the components are guided against hitting one another.

According to a further object, a printing apparatus is provided for a plate-like printing medium, especially a card or a mat with a label or several labels for labeling electrical devices, connectors, cables, or the like, which are stacked in a stack, including a separating device for separating a printing medium from the stack, and a printing device. This separating device is designed such that it has at least one drive element with a support component that is provided with at least one guide cam for a follower device for moving the support component between a starting position remote from the stack and an end position adjacent the stack. The follower device is guided along the guiding curve by means of a pivot lever construction. The guiding of the follower along the guide cam ensures that the support component, especially a plate or a component of different dimensions, can be positioned accurately in both the starting and ending positions, and at the same time, the production of high noise is avoided. The end position, as a dead point, is approached without noise, since the follower s permanently lies against the support component. The dead point is defined as the position at which no further movement occur.

Advantageously the guide cam is designed as a longitudinal side wall of a slot defined in the support element, since this is easy to produce by industrial manufacturing processes and permits accurate guidance of the support component, for example a plate.

Also advantageously the follower member is designed as a deflecting roller, since this can be moved along the guide cam without great frictional losses. More particularly, the roller is guided along the guide cam by means of a linkage arrangement. According to a first embodiment of the invention, this is designed as a four joint linkage construction, which consists of at least two first joint axes or points arranged on counterbearings, at which in each case a hinged bracket is connected with the stop means, and two second joint axes or points at the ends of the joint lever for coupling with a connecting rod.

In the area of each of the second joint axes or points a follower roller is provided, which is guided along the guide cam. This design permits positive guidance of the follower roller along the guide cam.

In addition, the follower roller is provided with a biasing spring for the positive return guiding of the plate from the end position, in which no movement takes place.

In a preferred embodiment, the plate is connected to a magnetic armature that is withdrawn into an electromagnet.

For gentle return control of the magnet armature, the electromagnet is advantageously connected by a switch to an RC circuit.

According to another object, a separating device is provided for a plate-like printing medium stacked in a stack, especially cards or labels for labeling electrical devices, connectors, cables, or the like, for separating the printing medium from the stack. The separating device has at least one drive element with at least one support component that is provided with at least one guide cam for a follower device for the movement between a start position and an end position. The follower is guided along the guide cam by means of an articulated linkage construction.

Finally, according to another object, a device is provided for moving a component between two positions, wherein the component is equipped with at least one guiding curve for a follower device for the movement of the support component between a start position and an end position (preferably approachable as a dead point). The follower device is guided along the guide cam by means of a linkage construction. Preferably each pivot axis of rotation is located at a 90° angle with the direction of movement of the component (guided mass). Even before the mass is set into motion, the stop is adjacent to the mass and maintains the contact permanently, so that no components hit one another upon reaching the end position.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1:
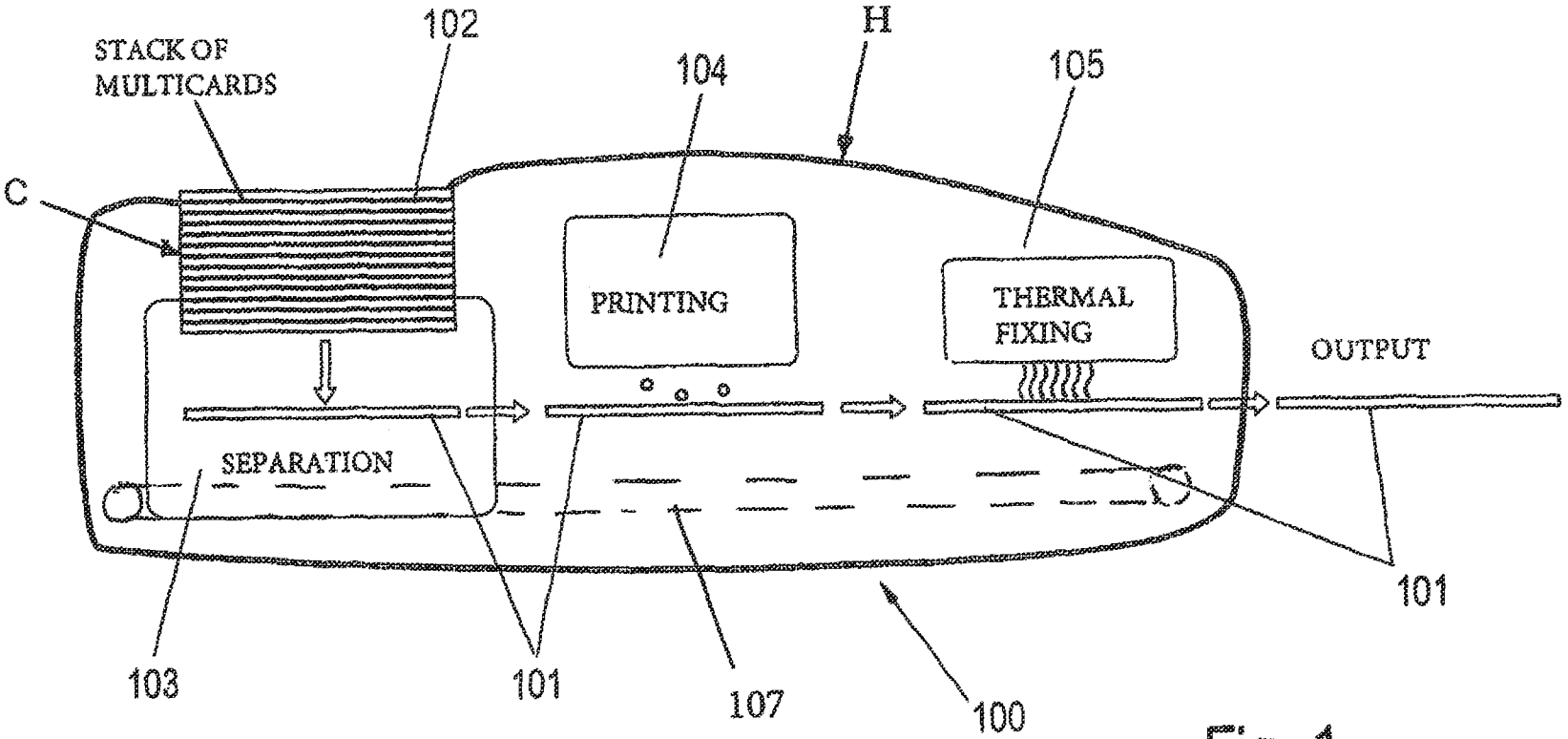
FIG. 1 is a diagrammatic sectional view of the printing apparatus of the present invention.

Referring first more particularly to FIG. 1, a printing apparatus 100 is disclosed including a housing H. containing a chamber C in which is supported a vertical stack 102 of horizontal planar objects 101 separated by permanent or removable spacer elements 110 (FIG. 2). The printer 100 is preferably an ink jet printer for plate-type printing media, such as cards or labels on a mat. However, another printer type may also be involved. These printing media 101, such as cards or mats with at least one label, have quite a high material strength and are usually made of plastic. Separating means 103 are provided for separating the lowermost object from the stack, which object is then transported by endless conveyor belt 107 to printing means 104 which prints selected information on the object. The printer 100 is preferably an ink jet printer for plate-type printing media, such as cards or labels on a mat. However, another printer type may also be involved. These printing media 101, such as cards or mats with at least one label, have quite a high material strength and are usually made of a synthetic plastic material. In the event that the object 101 is formed from a thermosetting synthetic plastic material, it is then transported to a thermal fixing station 105. The ink or the like is heat-fixed on the printing medium 101 by the drying device 105. After all process steps are complete, the printed card 101 is subsequently discharged outwardly of the housing chamber via an outlet opening contained in the end wall thereof. If removable, the spacer elements 110 could be from the object then, or at a later time.

Figure 2A:
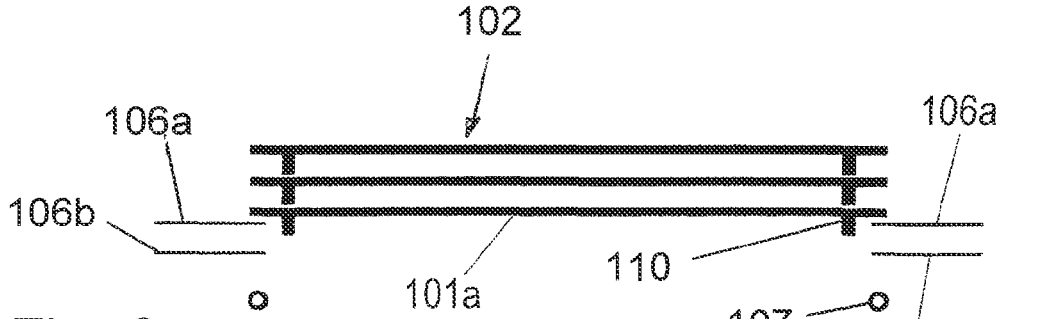
FIGS. 2*a*-2*d* are diagrammatic views illustrating the steps for operating the support members during the separation of the lowermost object of a stack.
Figure 2B:
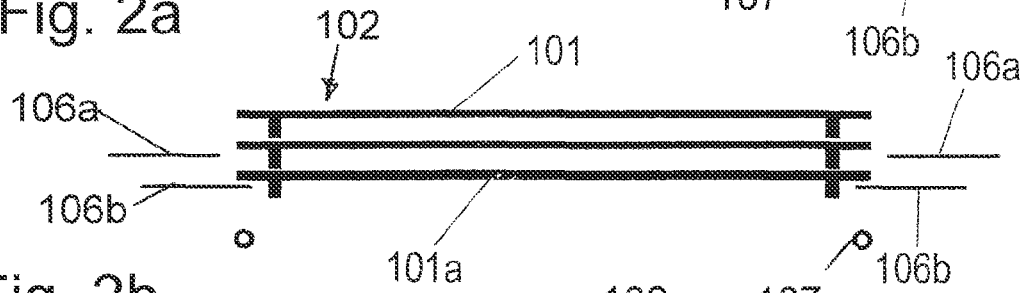
Figure 2C:
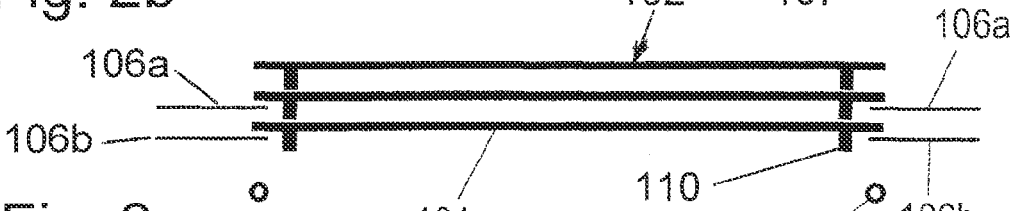
Figure 2D:
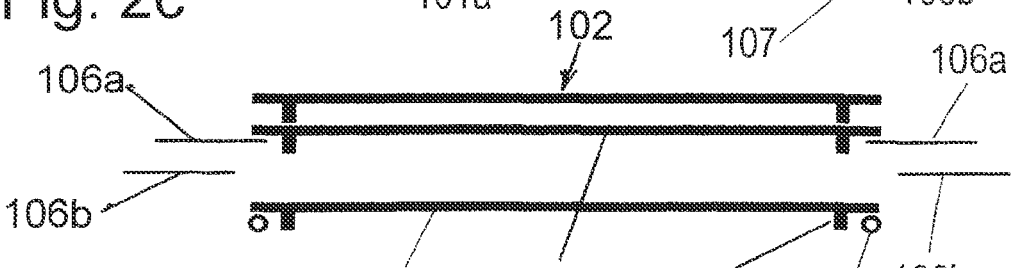

Referring now to FIG. 2*a*, it will be seen that the horizontal planar objects 101 of the stack are vertically spaced by permanent or removable spacer elements 110, with the lowermost object 101*a* of the stack being initially in engagement with an upper pair of opposed support pin arrangements 106*a*. When these two upper support pin arrangements are relatively quickly withdrawn from the stack as shown in FIG. 2*b*, the stack drops by gravity with the lowermost object 101*a* coming into engagement with the lower pair of opposed support pin arrangements 106*b*, with the stack now being supported by these lower pin members. The upper two support pin arrangements 106*a* are now relatively slowly reinserted into the stack as shown in FIG. 2*c*, whereupon the lower two support pin arrangements 106*b* are relatively quickly separated. The lowermost object 101*a* then drops by gravity from the stack onto the endless conveyor belt 107 as shown in FIG. 2*d*, with the remaining objects of the stack being supported by the upper two support pin arrangements 106*a*. The removed object 101*a* is then transported to the printer 104 by the endless conveyor 107, and the bottom row of pins 106*b* is then moved back into its first position so that the next card 101*b* can be separated.

Figure 3:
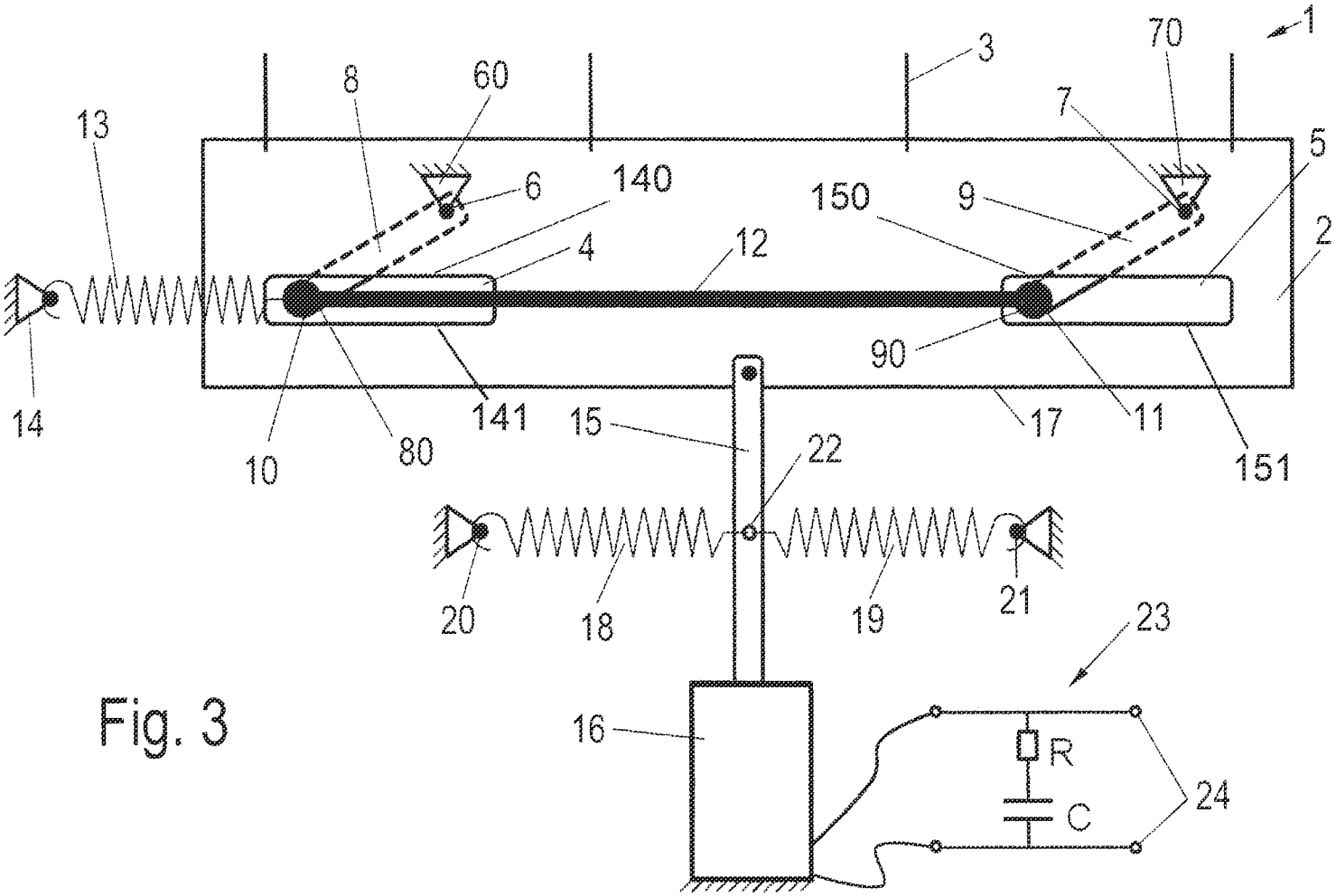
FIGS. 3 and 4 are diagrammatic views illustrating a first two-lever parallelogram-type embodiment of the invention when in the de-energized extended and energized retracted positions, respectively.

According to a first embodiment illustrated in FIG. 3, the separating means of the present invention comprises at least four separating arrangements 1, each of which can be moved back and forth between a start position and an end position to separate a lowermost card from the stack, as is further shown in FIG. 2. Each separating arrangement includes a horizontal support plate 2 that is mounted for horizontal sliding movement within the housing chamber toward and away from the stack 102 by electromagnetic motor means including a stationary electromagnet 16 fixed to the housing, and a movable armature 15 having a free end connected with the support plate. The support plate carries 2 a row of horizontal parallel support pins 3 that are arranged to extend into the stack when the electromagnetic motor is in the de-energized condition shown in FIG. 3, with the support plate being adjacent the stack. A pair of armature biasing springs 18 and 19 are connected at their adjacent ends with the armature, and at their remote ends 20 and 21 with the housing, which springs bias the movable armature toward the illustrated extended position relative to the stationary electromagnet 16.

The support plate 2 is guided during its horizontal movement relative to the stack by guide means including a pair of guide levers 8 and 9 that are pivotally connected at first ends by pivot axes 6 and 7 to the housing fixed supports 60 and 70, respectively. The second ends of the guide levers are pivotally connected by pivot axes 80 and 90 with the ends of a connecting rod 12, thereby to define a parallelogram-type linkage. The pivot axes of rotation of the linkage construction are at right angles to the direction of motion of the guided component (here a plate). Also connected with the lever second ends are rotatable follower rollers 10 and 11 that extend into guide slots 4 and 5, respectively, contained in the support plate 2. The opposed walls 140, 141 and 150, 151 of these slots define guide cam surfaces that are engaged by the rollers 10 and 11 respectively. It should be noted that the guide cam surface according to the invention can be understood not only as being linear, but also as a curved rolling path. Advantageously the rollers 10, 11 are supported so as to roll without large frictional losses along the guiding curve 140, 150 formed as the longitudinal sides of the slots. A linkage biasing spring 13 is connected at one end with the pivot axis 80 of the connecting rod 12, and at the other end with the fixed housing location 14. This linkage spring biases the connecting rod to the left to prevent the linkage from being locked up when the levers 8 and 9 are in the extended position of FIG. 4.

Figure 4:
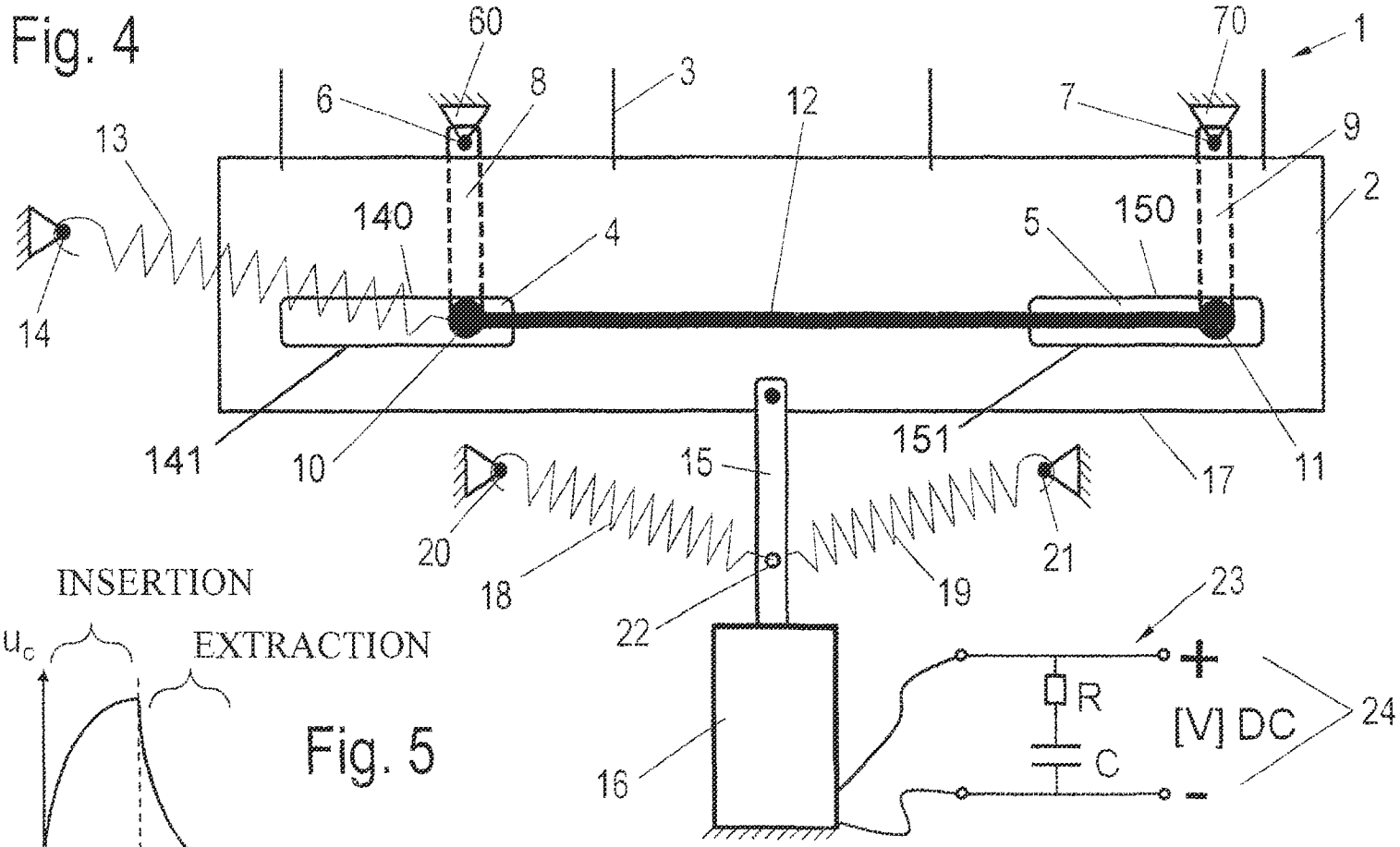

The electromagnet 16 of FIG. 3 includes a coil that is energized via an operating circuit 23 including a pair of input terminals 24, and a parallel branch containing a resistor R and a capacitor C. When a direct-current voltage V is applied across the input terminals 24 as shown in FIG. 4, the electromagnet 16 is energized, and the armature 15 is quickly withdrawn into the coil of the electromagnet, against the restoring force of the tension springs 18 and 19. This movement of the armature quickly displaces the support plate 2 and the row of support pins 3 away from the stack, with the movement of the support plate being guided by the counterclockwise movement of the levers 8 and 9, and the engagement of the rollers 10 and 11 with the cam surfaces 140 and 150, respectively. When the supply of the direct-current supply voltage is interrupted, the linkage spring 13 biases connecting rod 12 to the left to prevent locking-up of the linkage, and the armature springs 18 and 19 cause the armature 15 to be returned to the extended position of FIG. 3, whereby the support plate is displaced toward its FIG. 3 position adjacent the stack. Owing to the discharge effect of the capacitor C, this return action of the support plate is dampened and relatively slow, owing to the discharging of the capacitor, as shown by the capacitor discharge curve Uc of FIG. 5.

It is important to note that as a result of the plunging of the magnet armature 15 into the electromagnet 16, its tensile force acts on the plate 2. This exerts a reactive force on the rollers 10, 11 in such a manner that the articulated levers 8, 9 of the linkage perform a pivoting movement, which leads to a sliding movement of the deflecting rollers 10, 11 along the guide cam surfaces defined by the slots 4, 5. Since the two deflecting rollers 10, 11 are coupled by the connecting rod 12, guided movement of the plate 2 parallel to the housing wall takes place. The end position of the plate 2 is reached when the articulated rods 8, 9 are pivoted out in parallel to the direction of movement and thus the system has approached a dead point. At the end position both of the springs 18 and 19 are deflected and exert a restoring force on the magnet armature 15.

Figure 5:
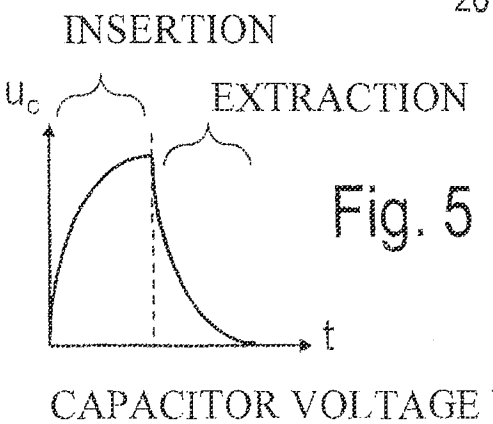
FIG. 5 is a voltage diagram illustrating the dampening operation of the resistance-capacitance circuit of FIGS. 3 and 4.

When the application of direct current on the terminal clamps 24 is interrupted by the opening of a switch (not shown), the condenser C discharges over the series resistor R and the voltage U on the electromagnet 16 drops continuously. The voltage curve of the capacitor is shown in FIG. 5. As a result, the magnet armature 15 is not suddenly withdrawn from the coil of the electromagnet 16, but instead a very gentle movement takes place. In addition the stopping of the plate 2 in its respective end position or dead point position as a result of guidance in the guide curves 140, 150 takes place with minimal momentum, or virtually momentum-free, and thus correspondingly with little or no noise, since the movable stop part is permanently attached to the moving mass and thus at no time do components hit one another.

When the voltage U on the electromagnet 16 decreases, the magnet armature 15 moves back out of the electromagnet 16 and the plate 2 with the pins 3 moves back to its start position. In this process a force is exerted on the stop 10 by the moving magnet armature 15 and also by the spring 13; this force drives the stop 10 from its end point back in the direction of the other side of the guiding curve 140. As a result of the coupling of the stop 10 over the connecting rod 12 with the other stop 11, this stop 11 also moves along the guiding curve 150, and the articulated rods 8,9 undergo a pivoting motion, so that the plate 2—and thus the separating pins 3 attached to it—returns to its start position. At this point the springs 18 and 19 are almost horizontally aligned and hold the rollers 10, 11 and the magnet armature 15 and the plate 2 in a defined start position.

Through the guidance of the rollers 10, 11 by means of a four joint construction in a guiding curve 140, 150 it is ensured that the plate 2 can be exactly positioned both in the start position and in the end position, since no components hit one another. In addition, high noise development is avoided, since as a result of a continuously decreasing voltage curve provided by the RC element, a soft movement of the four-joint construction back to the start position is made possible. In addition, the mechanical stress on the plate 2 can be distinctly reduced.

Figure 6:
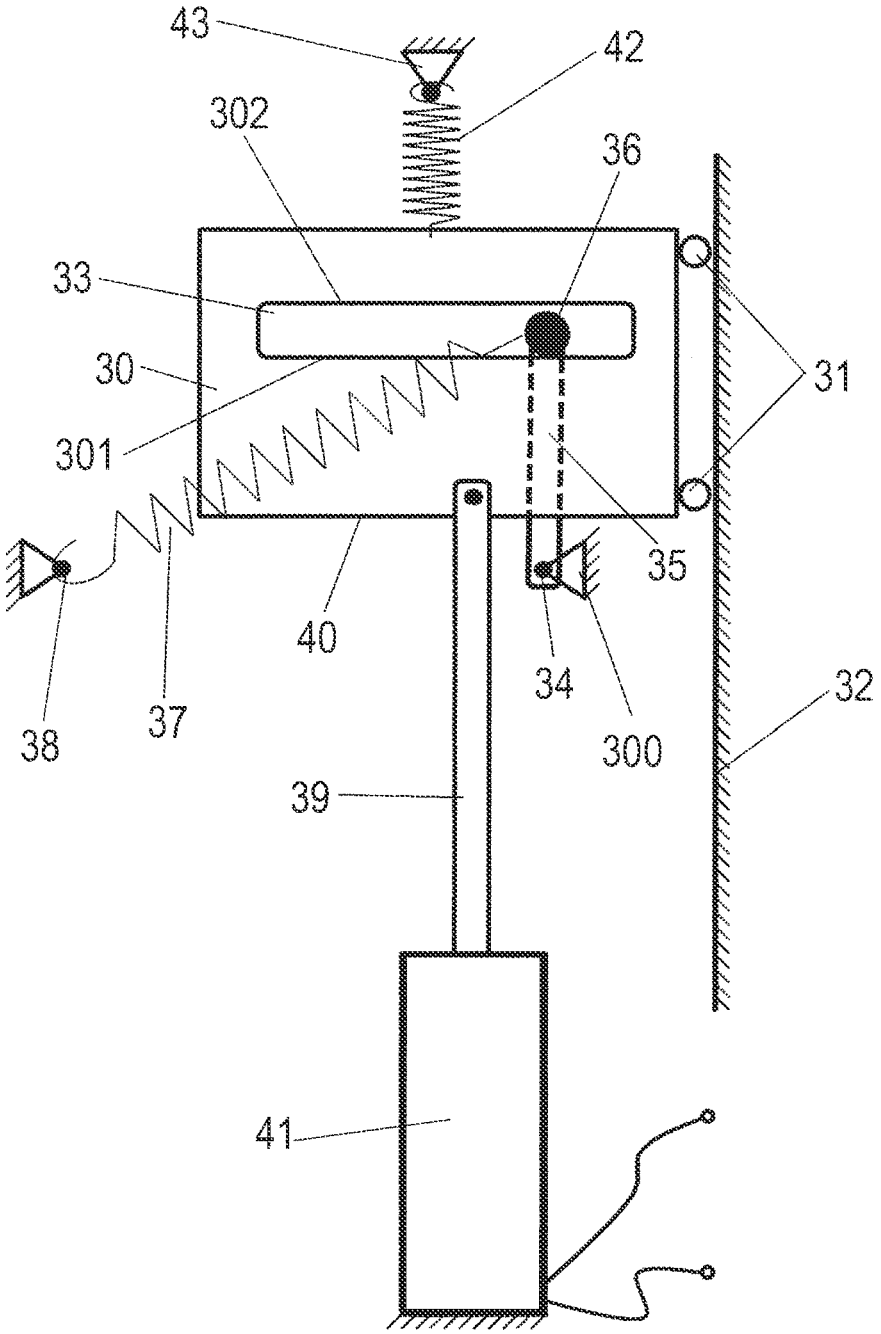
FIGS. 6 and 7 are diagrammatic views illustrating the operation of a second single-lever embodiment of the invention when in the de-energized extended and energized retracted conditions, respectively.

According to a second single-lever embodiment shown in FIG. 6, the support plate 30 is displaced toward and away from the stack of objects by the movable armature 39 of the electromagnetic motor means including stationary electromagnet 41. For guidance, the support plate is provided with a single slot 33 having opposed side walls defining cam surfaces 301, 302, and a single guide lever 35 that is connected at one end by pivot 34 with the housing fixed support 300. Roller 36 is rotatably connected with the lever second end and extends into the slot 33. Lever spring 37 connected between the lever second end and the fixed support 38 biases the lever to the left away from the illustrated pivot end position. To further guide the support plate, it is provided with a plurality of rollers 31 that ride on the stationary guide track 32 provided on the fixed housing, which guide is parallel with the direction of axial travel of the armature 39. A support plate spring 42 connected between the support plate 30 and the fixed support connection 43 biases the armature 39 and the support plate 30 toward the extended positions shown in FIG. 6, wherein the support plate is adjacent the stack.

Figure 7:
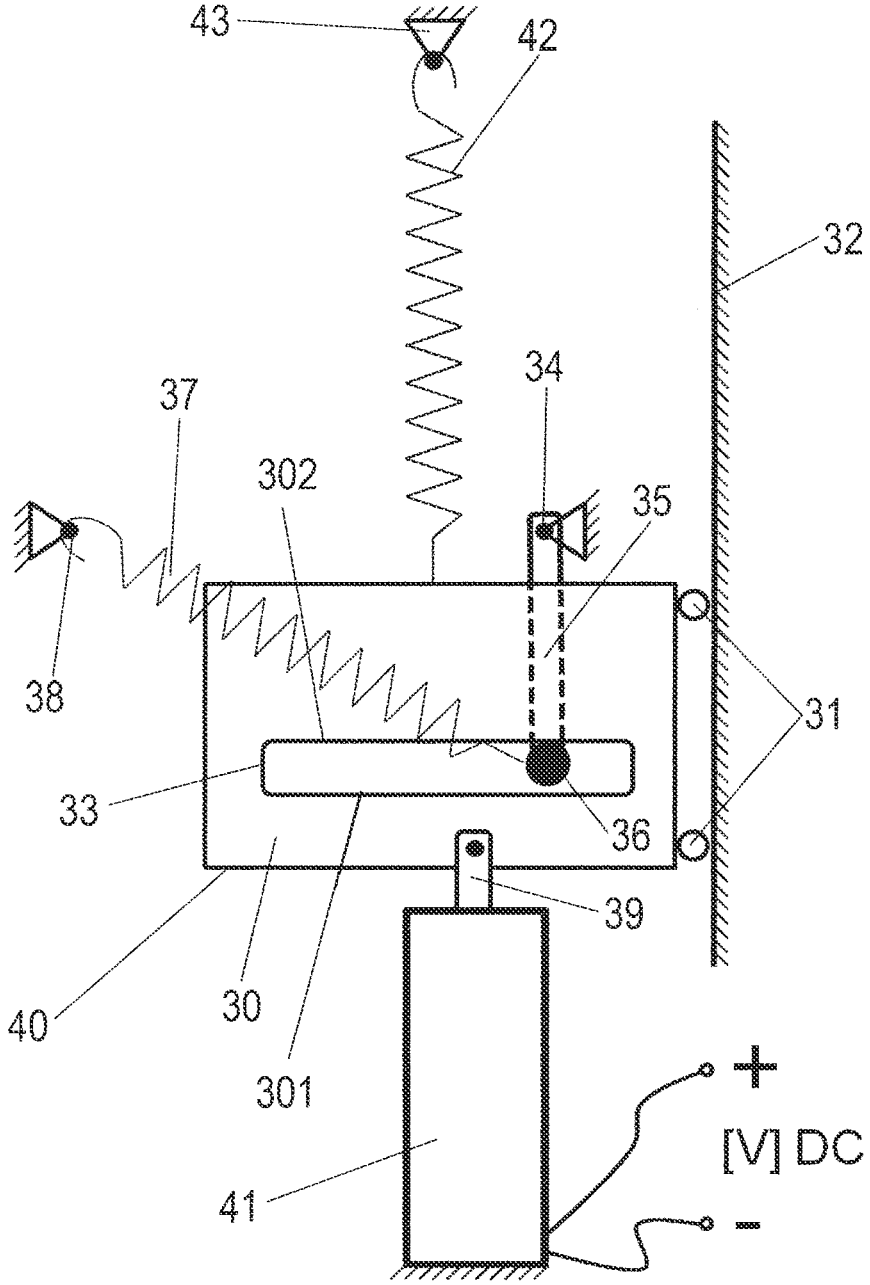

Upon energization of the electromagnet by the application of a direct-current voltage to the operating terminals as shown in FIG. 7, the armature 39 is quickly withdrawn into the electromagnet, the support plate 40 is displaced away from the stack, the tension spring 42 is expanded, and the guide lever 35 is pivoted in the counterclockwise direction about the pivot axis 34. During this travel of the support plate, it is guided by the cooperation between the lever roller 36 and the cam surface 302 of slot 33, and between the plate rollers 31 and the stationary guide track 32.

Upon de-energization of the electromagnet, the armature 39 and the support plate 30 are returned by spring 42 to their positions of FIG. 6, with the support plate being adjacent the stack, and with the support pins (not shown) extending into the stack. If this arrangement were to be provided with the RC circuit of FIGS. 3 and 4, the support plate and the armature would be subjected to the slow-return capacitor-discharge dampening operation of FIG. 5.

In this embodiment, the articulated lever 35 describes a semicircular motion and reaches a second end position as a dead point, when the articulated lever 35 is in a parallel orientation relative to the track 32. Since the maximum deflection of the plate 30 is determined by the semicircular motion of the articulated lever 35, the length of the articulated lever 35 thus predetermines the travel distance of the plate 2. In the first half of the path of the plate 30, the roller 36 moves along the first longitudinal side 301 of the slot hole 33 until the articulated rod 35 has rotated through 90°. Then the other longitudinal side 302 of the slot hole 33 represents the guiding curve, and the stop means 36 moves along this curve 302, so that the articulated lever 35 rotates through a further 90°.

As a result of the guidance of the roller 36 by a joint construction along a guiding curve 301, 302, it is ensured that the plate 30 can be exactly positioned in both the start and end positions. Since the roller 36 is carried along during the movement of the component or the plate 30, the component is braked abruptly, but it does not hit the end of a path of motion hard against an end stop. Instead, according to the invention the end point at the end of a guiding curve 301, 302 determines the end position of the stop means 36 in the manner of a dead point and thus determines the end position of the component or the plate 30.

In the embodiment shown, movement of the roller 36 is provided along two guiding curves 301, 302 accomplished by the two longitudinal sides of the slot 33. In this process in each case one guiding curve serves for one direction of movement. However, it is also conceivable that only one guiding curve 301 is provided and the articulated rod can then achieve an end position of the moving mass.

In addition, as a result of a continuously decreasing voltage curve provided by an RC element, here also a very soft movement of the joint construction back into the start position can be provided, which leads to a further reduction of noise production. Furthermore the mechanical stress on the plate 30 can be reduced distinctly.

In a further development of the invention it is possible to produce the dimensions of the plate with the stop means such that it can be placed inside of an electromagnet.

While in accordance with the provisions of the Patent Statutes the preferred forms and embodiments of the invention have been illustrated and described, it will be apparent to those skilled in the art that changes may be made without deviating from the invention described above.

What is claimed is:

1. Printing apparatus for printing information on a planar object, comprising:

(a) a housing (H) containing a chamber (C) adapted to receive a vertical stack (102) of horizontally-arranged vertically-spaced planar objects (101) formed from a thermosetting synthetic plastic material, said stack defining a vertical zone and including a lowermost object (101*a*);

(b) separating means (103) for removing the lowermost object from the stack, said separating means including:

(1) stack support means for supporting the stack within said chamber, said stack support means including a first pair of stack support arrangements (106*b*) arranged in a first horizontal plane in opposed relation on opposite sides of the stack, and a second pair of stack support arrangements (106*a*) arranged correspondingly in a second horizontal plane above said first plane, each stack support arrangement of said first and second pairs of stack support arrangements including:

(a) a support member (2; 30) supported in said chamber for alternate horizontal displacement between adjacent and remote positions relative to the stack, and (b) at least one supporting element (3) extending horizontally from said support member within said vertical zone when said support member is in said adjacent position;

(2) drive means (16; 41) for displacing said support member between said adjacent and remote positions relative to the stack, thereby to remove the lowermost object from the stack; and (3) guide means for guiding said support member during the displacement thereof between said remote and said adjacent positions relative to the stack, said guide means including:

(a) at least one guide lever (8, 9; 35) having a first end pivotally connected with said housing, said at least one lever also having a second end; and (b) a guide follower member (10, 11; 36) connected with said second end of said at least one guide lever, said guide follower member being in engagement with a guide cam surface (140, 141, 150, 151; 301, 302) defined on said support member;

(c) printing means (104) arranged in said chamber for printing information on the removed object; and (d) heating means (105) arranged in said chamber for fixing the information to the removed object.

2. Separating apparatus for separating an object from a vertical stack (102) of horizontal vertically-spaced planar objects (101), said stack defining a vertical zone and having a lowermost object, comprising:

(a) a housing (H) containing a chamber (C);

(b) stack support means for supporting the stack within said housing chamber, comprising at least one support arrangement having:

(1) a support member (2; 30) mounted within said housing chamber for alternate horizontal displacement between adjacent and remote positions relative to the stack, and (2) a horizontal row of support pins (3) extending horizontally from said support member within the vertical zone when said support member is in said adjacent position;

(c) drive means (16; 41) for displacing said support member between said adjacent and remote positions relative to the stack, such that the lowermost object is removed from the stack; and (d) guide means for guiding said support member during the displacement thereof between said remote and said adjacent positions relative to the stack, said guide means including:

(1) at least one guide lever (8, 9; 35) having a first end pivotally connected with said housing, said at least one guide lever also having a second end; and (2) a guide follower member (10, 11; 36) connected with said second end of said at least one guide lever, said guide follower member being in engagement with a guide cam surface (140, 141, 150, 151; 301, 302) defined on said support member.

3. Separating apparatus as defined in claim 2, wherein said support member comprises a planar support plate (2; 40).

4. Separating apparatus as defined in claim 3, wherein said planar support plate contains a slot (4, 5; 33) having a wall surface that defines said guide cam surface.

5. Separating apparatus as defined in claim 4, wherein said guide follower member comprises a roller (10,11; 36) rotatably connected with said second end of said at least one guide lever.

6. Separating apparatus as defined in claim 4, wherein said guide means further includes:

(3) a second guide lever (9) having a first end pivotally connected with said housing, said second guide lever having a second end;

(4) a second guide roller (11) rotatably connected with said second end of said second guide lever for engagement with a second guide cam surface (150, 151) contained in said planar support plate; and (5) a connecting rod (12) pivotally connected between said second ends of said guide levers, thereby to define a parallelogram-type linkage arrangement.

7. Separating apparatus as defined in claim 6, wherein said guide means further includes:

(6) a rod biasing spring (13) connected between said connecting rod and said housing for biasing said rod longitudinally in a given direction relative to said planar support plate.

8. Separating apparatus as defined in claim 7, wherein said drive means comprises:

(1) an electromagnet including a stator coil (16) connected with said housing, said stator coil having a given longitudinal axis; and (2) an armature (15) operable by and arranged for axial displacement relative to said stator coil longitudinal axis, said armature having a free end connected with said planar support plate.

9. Separating apparatus as defined in claim 8, wherein said drive means further includes:

(3) armature spring means (18, 19) biasing said armature toward an extended position relative to said stator coil.

10. Separating apparatus as defined in claim 5, wherein said guide means comprises a single guide lever (35) connected at one end to said housing, said guide means further including:

(3) a linear guide track (32) supported by said housing and extending in a direction parallel with a first linear direction of movement of said drive means; and (4) support roller means (31) mounted on said planar support plate for engagement with said linear guide track.

11. Separating apparatus as defined in claim 10, wherein said drive means comprises:

(1) an electromagnet including a stator coil (41) connected with said housing, said stator coil having a given longitudinal axis; and (2) an armature (39) operable by and arranged for axial displacement between extended and retracted positions relative to said stator coil axis, said armature having a free end connected with said planar support plate, said at least one guide lever being pivoted between first and second end positions when said armature is in its extend and retracted positions, respectively.

12. Separating apparatus as defined in claim 11, wherein said drive means further includes:

(3) armature spring means (42) biasing said armature toward said extended position.

13. Separating apparatus as defined in claim 12, wherein said guide means further includes:

(4) a lever spring (37) connected between said at least one guide lever second end and said housing, thereby to pivotally bias said at least one guide lever toward a center position between said first and second lever end positions.

14. Separating apparatus as defined in claim 2, wherein said drive means comprises:

(1) an electromagnet including a stator coil (16; 41) connected with said housing, said stator coil having a given longitudinal axis;

(2) an armature (15; 39) operable by and arranged for axial displacement between extended and retracted positions relative to said stator coil, said armature having a free end connected with said planar support plate;

(3) spring means (18, 19; 42) biasing said armature toward its extended position relative to said electromagnet; and (4) means including a resistance and capacitance circuit (23) for applying a direct-current operating voltage across said electromagnet, whereby upon interruption of the supply of the operating voltage, the armature is gradually returned toward its extended condition.

15. Separating apparatus as defined in claim 2, wherein said stack support means includes a first pair of support arrangements (**106*b*) arranged in a first horizontal plane in opposed relation on opposite sides of the stack, and a second pair of support arrangements (106*a***) arranged correspondingly in a second horizontal plane above said first plane, said pairs of support arrangements being independently operated by said drive means to remove the lowermost object from the stack.

* * * * *